US010179962B2

(12) United States Patent
Carr et al.

(10) Patent No.: US 10,179,962 B2
(45) **Date of Patent: *Jan. 15, 2019**

(54) LAUNDRY TREATING APPLIANCE LAUNDRY MOVER WITH LIQUID DIVERTER

(71) Applicant: WHIRLPOOL CORPORATION, Benton Harbor, MI (US)

(72) Inventors: David W. Carr, Saint Joseph, MI (US); Dale E. Mueller, Benton Harbor, MI (US); Mary E. Zeitler, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/680,277

(22) Filed: Aug. 18, 2017

(65) Prior Publication Data

US 2017/0342620 A1 Nov. 30, 2017

Related U.S. Application Data

(63) Continuation of application No. 13/958,859, filed on Aug. 5, 2013, now Pat. No. 9,777,418.

(51) Int. Cl.

| | |
|---|---|
| ***D06F 17/00*** | (2006.01) |
| ***D06F 17/10*** | (2006.01) |
| ***D06F 13/00*** | (2006.01) |

(52) U.S. Cl.

CPC ..... *D06F 17/10* (2013.01); *D06F 13/00* (2013.01)

(58) Field of Classification Search

CPC ..... D06F 13/00; D06F 17/10; D06F 13/02; D06F 33/02; D06F 17/06

USPC ..... 68/134, 133, 53, 18 FA, 131, 132, 23.7, 68/23.6, 54, 148; 8/137, 159, 158; 366/278, 317, 165.2, 243, 265, 329.1

See application file for complete search history.

(56) References Cited

U.S. PATENT DOCUMENTS

| | | | | |
|---|---|---|---|---|
| 2,345,185 | A * | 3/1944 | Edgar | A47L 15/0097 134/115 R |
| 4,397,163 | A * | 8/1983 | Clearman | D06F 13/02 68/134 |
| 5,295,373 | A * | 3/1994 | Lim | D06F 17/12 68/12.05 |
| 5,680,780 | A * | 10/1997 | Kim | D06F 17/10 68/134 |
| 5,829,276 | A | 11/1998 | Suh et al. | |
| 5,906,118 | A | 5/1999 | Cho et al. | |
| 6,070,439 | A | 6/2000 | Jung | |
| 9,777,418 | B2 * | 10/2017 | Carr | D06F 17/10 |

(Continued)

FOREIGN PATENT DOCUMENTS

| | | | |
|---|---|---|---|
| JP | 8057184 | A | 3/1996 |
| JP | 9285679 | A | 11/1997 |

(Continued)

*Primary Examiner* — David G Cormier
*Assistant Examiner* — Thomas Bucci

(57) ABSTRACT

A laundry mover for a laundry treating appliance may include a protrusion located on an upper side of the laundry mover and forming an open-bottom cavity. The protrusion may have at least one opening fluidly communicating the cavity with a portion of the treating chamber above the protrusion. A diverter may be located on a lower side of the laundry mover.

20 Claims, 17 Drawing Sheets

(56) References Cited

U.S. PATENT DOCUMENTS

| | | | | |
|---|---|---|---|---|
| 2006/0162094 | A1* | 7/2006 | La Belle | D06F 13/02 8/159 |
| 2014/0076004 | A1* | 3/2014 | Lee | D06F 17/10 68/134 |

FOREIGN PATENT DOCUMENTS

| | | | | | |
|---|---|---|---|---|---|
| JP | 9299684 | A | | 11/1997 | |
| JP | 2006068192 | A | | 3/2006 | |
| KR | 20130037657 | A | * | 4/2013 | D06F 17/10 |
| KR | 20130037657 | A | | 4/2013 | |

* cited by examiner

LAUNDRY TREATING APPLIANCE LAUNDRY MOVER WITH LIQUID DIVERTER

CROSS-REFERENCE TO RELATED APPLICATIONS

This application is a continuation of U.S. patent application Ser. No. 13/958,859 filed on Aug. 5, 2013, now U.S. Pat. No. 9,777,418, issued Oct. 3, 2017, the entirety of which is incorporated herein by reference.

BACKGROUND

Some laundry treating appliances, such as washing machines, include a laundry mover, examples of which include, but are not limited to, impellers and agitators. A laundry mover is typically rotatable within a basket during the treating of laundry to facilitate movement of liquid and/or laundry in the basket. The type of laundry mover and movement of the laundry mover may be selected to achieve desired characteristics of liquid and/or laundry movement, such as direction and speed.

BRIEF SUMMARY

A laundry treating appliance including a treating chamber receiving laundry for treatment, and a laundry mover located in the treating chamber and rotatable about a rotational axis, the laundry mover including a protrusion located on an upper side of the laundry mover and forming an open cavity on a lower side of the laundry mover, the protrusion further having at least one opening fluidly communicating the cavity with a portion of the treating chamber above the protrusion, and a diverter located on a lower side of the laundry mover and depending from an upper wall of the protrusion within the open cavity.

DETAILED DESCRIPTION

Figure 1:
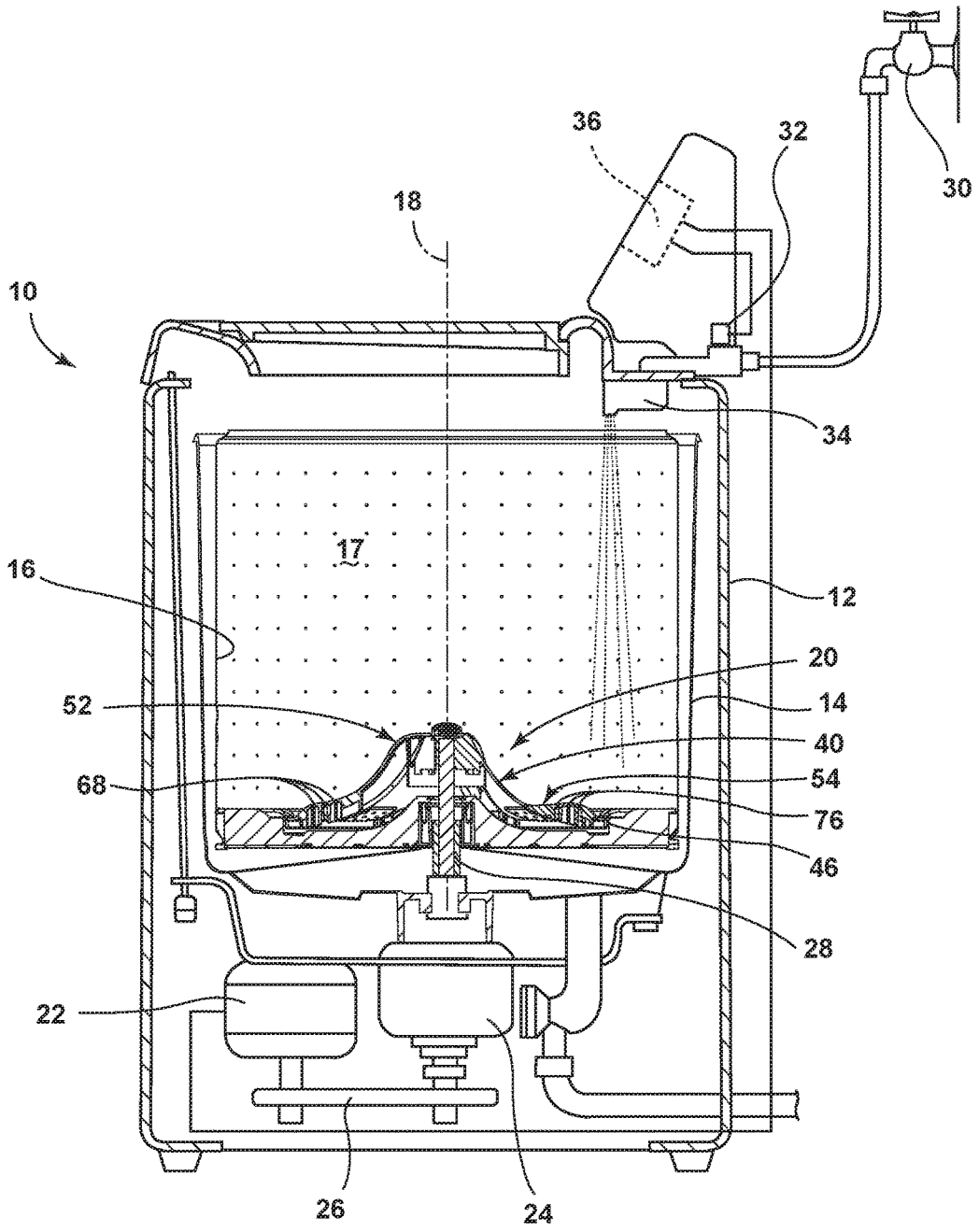
FIG. 1 is a schematic sectional view of a fabric treating appliance in the form of a washing machine having a laundry mover in the form of an impeller according to one embodiment.

Automatic washing machines may typically comprise a perforated basket or drum for holding a laundry load, which may include garments, sheets, towels, and other fabric items, and an imperforate tub containing a liquid typically comprising water or a mixture of water and detergent or other treatment aid. A laundry mover may be coaxially mounted in the bottom of the basket and adapted for angular oscillation in order to agitate the laundry load. In one configuration, the basket, the laundry mover, and the tub may be oriented about a vertical axis.

Traditionally, a vertical axis laundry mover may be configured as an impeller or an agitator. The impeller is typically a low-profile base element having a circular periphery, with protrusions extending upward from the base element. The agitator typically has a base, which may be in combination with an auger that extends along the vertical axis approximately the height of the tub.

It is generally understood that a deep fill wash cycle, typically associated with an agitator, refers to a cloth to liquid ratio that, when combined with the action of the laundry mover, produces fluid motion which significantly aids in the motion of the laundry items even if the actual liquid level in the machine is not near the top of the basket. The laundry is considered suspended in the free fluid, or submerged, when there is sufficient fluid power to directly result in movement of the laundry. The combination of the agitator contacting the laundry, the liquid moving through the laundry, and the relative contact between the laundry items contribute to imparting mechanical energy to the laundry for cleaning.

Likewise, a low fill wash cycle, also called a low water wash cycle and typically associated with an impeller, generally refers to a cloth to liquid ratio that, when combined with the action of the laundry mover, produces insufficient fluid motion to directly result in cloth motion regardless of the direction of fluid motion. In fact, the resulting cloth motion may still be present even if very little free fluid is present. In this process, a laundry item is not considered to be suspended or submerged in the free liquid even if the actual liquid level is near the top of the basket or near the top of the laundry load. The mechanical energy for cleaning the laundry in the low water wash primarily comes from the interaction between the laundry items.

In a vertical axis washing machine with a deep fill wash cycle where the laundry is completely submerged, reciprocal movement of an agitator moves the laundry items along a toroidal, or donut-shaped, path extending radially inwardly toward the center of the basket, downwardly along the vertical axis, radially outwardly toward the outer wall of the basket, and upwardly along the perimeter of the basket where they repeat the cycle. One full cycle along this path is commonly referred to as a "rollover."

In a low water cycle, such as where the laundry items are wetted but not submerged, the movement of the laundry items by reciprocating the impeller moves the laundry items in an opposite direction than that of the agitator with a deep fill in what has been termed an "inverse toroidal rollover." The inverse toroidal rollover typically moves the laundry items along a path extending radially outwardly toward the outer wall of the basket, downwardly along the perimeter of the basket, radially inwardly toward the center of the basket, and upwardly along the vertical axis where they repeat the cycle.

The present invention is directed to a laundry mover, such as an impeller, agitator, combination impeller and agitator, or other type of laundry mover. FIG. 1 is a schematic view of a laundry treating appliance according to an exemplary embodiment. The laundry treating appliance may be any appliance that performs a cycle of operation to clean or otherwise treat items placed therein, non-limiting examples of which include a horizontal or vertical axis clothes washing machine; a combination washing machine and dryer; a tumbling or stationary refreshing/revitalizing machine; an extractor; a non-aqueous washing apparatus; and a revitalizing machine.

The laundry treating appliance of FIG. 1 is illustrated as a washing machine 10, which may include a structural support system comprising a cabinet 12 that defines a housing within which a laundry holding system resides. The cabinet 12 may be a housing having a chassis and/or a frame, defining an interior receiving components typically found in a conventional washing machine, such as motors, pumps, fluid lines, controls, sensors, transducers, and the like. Such components will not be described further herein except as necessary for a complete understanding of the invention.

The illustrated exemplary washing machine 10 may include a watertight tub 14 installed in the cabinet 12. A perforated basket 16 may be mounted in the tub 14 for rotation about an axis of rotation, such as, for example, a central, vertical axis 18 extending through the center of a laundry mover in the form of an impeller 20, which will be described in further detail below. The basket 16 may at least partially define a laundry treating chamber 17 receiving a load of laundry items for treatment, and the impeller 20 may be mounted within the treating chamber 17. A drive motor 22 operating a transmission 24 through a drive belt 26 may be utilized to rotate the basket 16 and the impeller 20. The impeller 20 may be positioned above the floor of the basket 16 and rotated by a drive shaft 28 extending through an opening in the floor of the basket 16. The illustrated drive system for the basket 16 and the impeller 20 is provided for exemplary purposes only and is not limited to that shown in the drawings and described above; the particular drive system is not germane to the invention. The washing machine 10 may be fluidly connected to a liquid supply 30 through a valve assembly 32 that may be operated to selectively deliver liquid, such as water, to the tub 14 through an outlet 34, which is shown by example as being positioned at one side of the tub 14. The illustrated liquid supply system for the washing machine 10 is provided for exemplary purposes only and is not limited to that shown in the drawings and described above; the particular liquid supply system is not germane to the invention. A control panel 36 enables the operator to control the operation of the washing machine 10.

Figure 2:
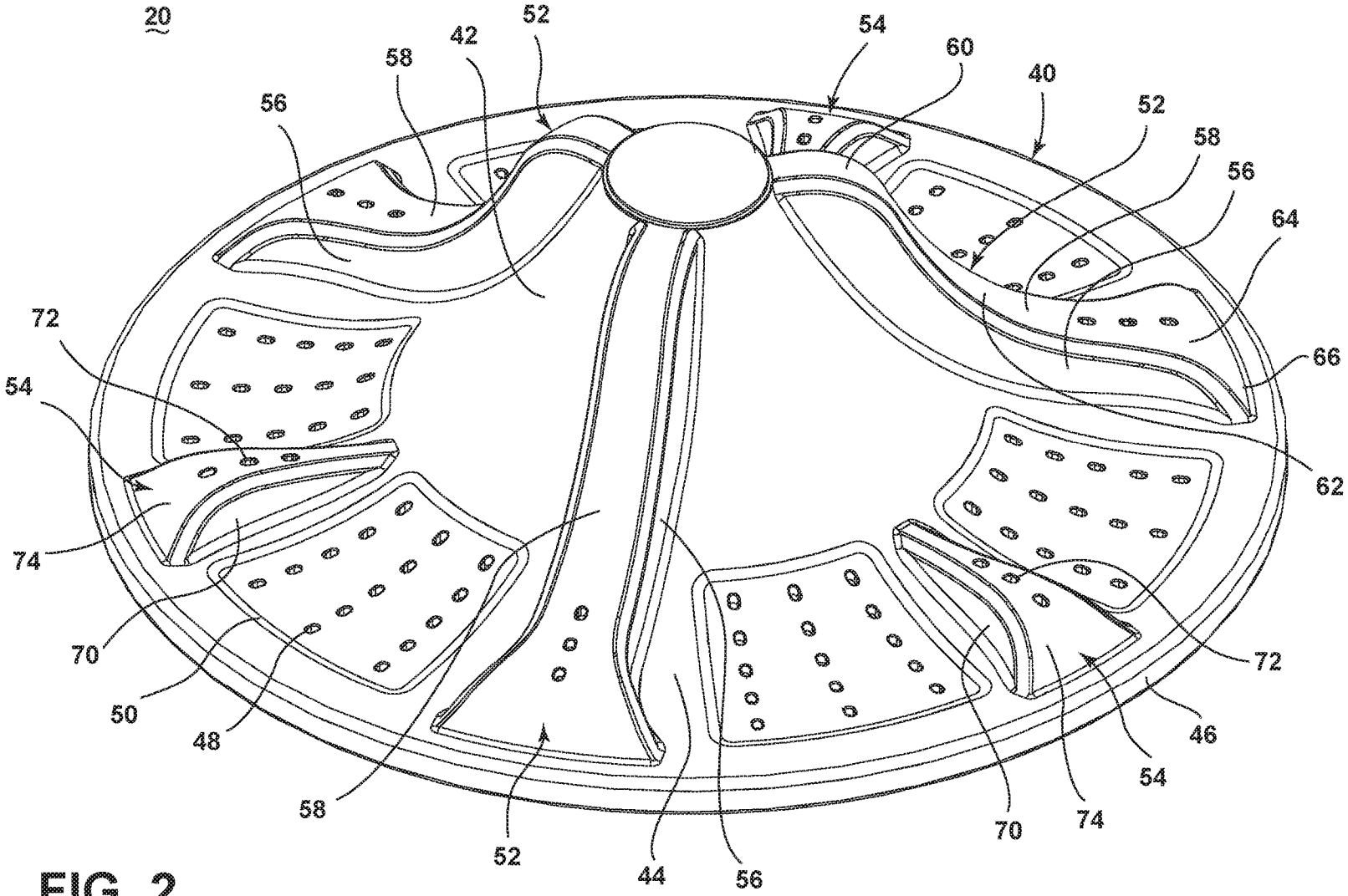
FIG. 2 is a perspective view of the impeller of FIG. 1.

Referring now to FIG. 2, which is a perspective view of the impeller 20 from FIG. 1, the impeller 20 may include a base 40 with a raised center 42 having an arcuate wall that transitions to an outer skirt 44 terminating at a generally circular outer periphery 46, which may be in the form of a depending lip. Several apertures 48 may extend through the base 40, and in the illustrated embodiment, the apertures 48 are arranged in sets of three radial lines starting around the transition between the raised center 42 and the outer skirt 44 and extending towards the outer periphery 46. The sets of the apertures 48 may be located within a depression 50 in the base 40 and may be spaced from each other by raised protrusions 52 and secondary protrusions 54 extending upward from the base 40. The apertures 48 may be optional and, if present, may have any suitable configuration on the base 40.

Figure 3:
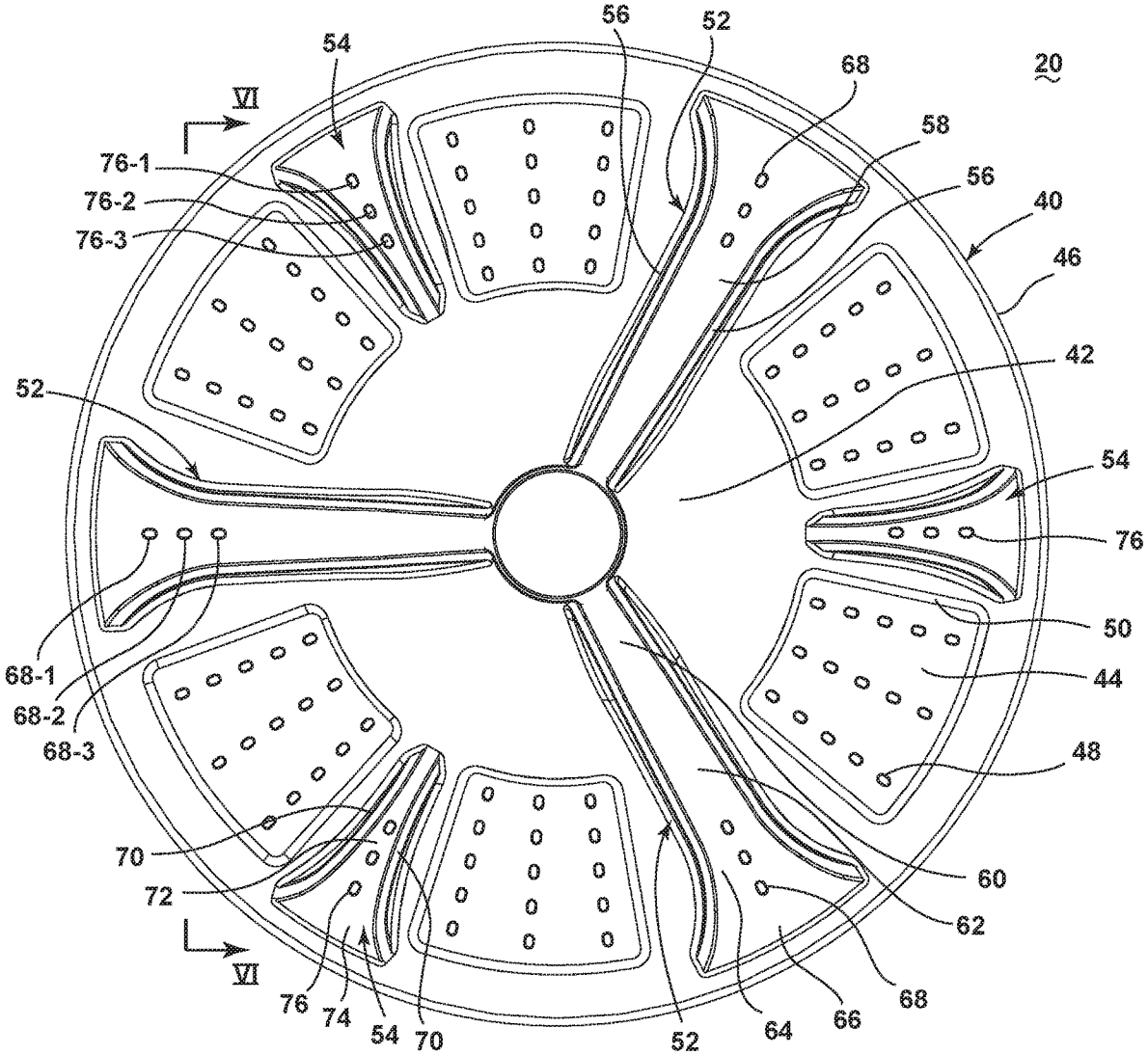
FIG. 3 is a top view of the impeller of FIG. 1.

With continued reference to FIG. 2, the protrusions 52 may extend radially along the raised center 42 and the outer skirt 44. In particular, each of the protrusions 52 may be formed by a pair of opposing side walls 56 that meet at their upper ends to form an upper wall 58. The upper wall 58 defines the profile of the protrusion 52, which may project in a generally perpendicular outward direction from the top of the raised center 42 before curving downward at a shoulder 60, then upward at a transition 62 located at about the transition between the raised center 42 and the outer skirt 44, and then downward again at an outer section 64 along the outer skirt 44 before terminating at a front wall 66. As best seen when viewing the impeller 20 from above in FIG. 3, which is a top view of the impeller 20, moving radially outward from the center, the upper wall 58 gradually widens along the raised center 42 and a portion of the outer skirt 44 and then rapidly widens when the upper wall 58 curves downward to form the front wall 66. Additionally, the protrusions 52 each have, in the upper wall 58, a plurality of openings 68 located in the portion of the protrusion 52 on the outer skirt 44, i.e., the outer section 64. As an example, the protrusions 52 each may have three of the openings 68-1, 68-2, 68-3. The protrusions 52 may have any suitable configuration and are not intended to be limited to those described above and shown in the illustrations.

As mentioned above, in addition to the protrusions 52, the impeller 20 may include the secondary protrusions 54. The term "secondary" is employed solely to differentiate the secondary protrusions 54 from the protrusions 52 and is not intended to attribute any characteristics to the secondary protrusions 54, even though it is possible for the protrusions 52, 54 to have different characteristics. The secondary protrusions 54 may be positioned between adjacent protrusions 52, such as a configuration where one of the secondary protrusions 54 is located between adjacent protrusions 52 equidistant from each of the adjacent protrusions 52. The secondary protrusions 54 may be formed by a pair of opposing side walls 70 that meet at their upper edges to define an upper wall 72 that curves downward to form a front wall 74. When viewing the impeller 20 from above, as in FIG. 3, the secondary protrusions 54 may have a generally triangular configuration, with one of the corners of the triangle being located at the transition between the raised center 42 and the outer skirt 44 (i.e., a vertex formed by the intersection of the side walls 70) and the others positioned near the outer periphery 46. Additionally, the secondary protrusions 54 may each have, in the upper wall 72, a plurality of openings 76 similar to the openings 68 of the protrusions 52. As an example, the secondary protrusions 54 each may have three of the openings 76-1, 76-2, 76-3. The secondary protrusions 54 may have any suitable configuration and are not intended to be limited to those described above and shown in the illustrations.

Figure 4:
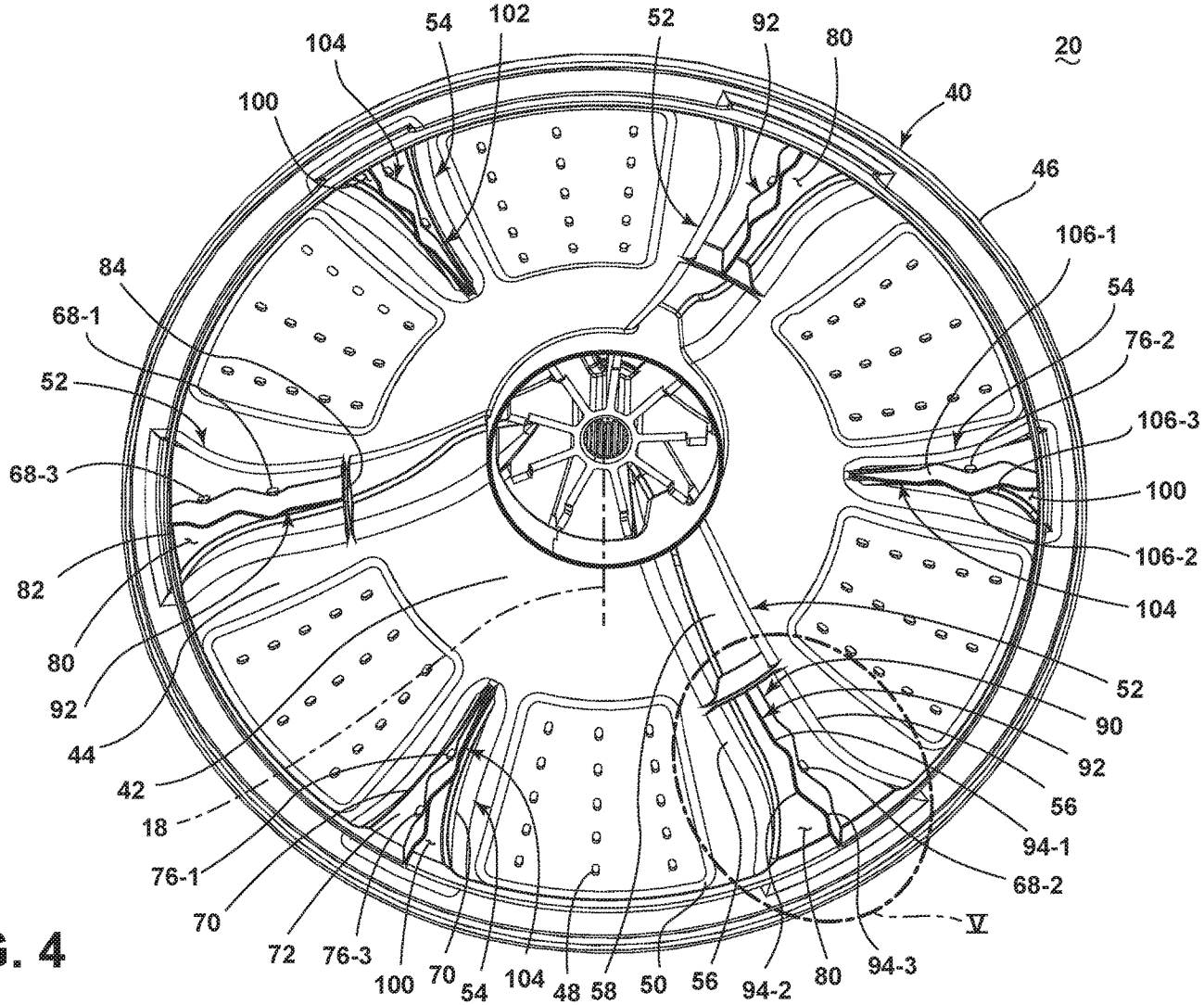
FIG. 4 is a bottom perspective view of the impeller of FIG. 1.

Referring now to FIG. 4, which is a bottom perspective view of the impeller 20, the protrusions 52 may form an open-bottom cavity 80 on the underside of the base 40. The cavity 80 may be formed between the side walls 56 in the circumferential direction and between an outer support wall 82 and an inner support wall 84 in the radial direction. The outer support wall 82 may be part of a ring spaced radially inward from the peripheral lip of the outer periphery 46 and depending from the outer skirt 44. The inner support wall 84 may span the protrusion side walls 56 near the transition from the raised center 42 to the outer skirt 44. The openings 68 may be positioned such that they are between the outer and inner support walls 82, 84, thereby fluidly communicating the cavity 80 with the area above the impeller 20. The cavity 80 may have any suitable configuration depending on the configuration of the protrusion 52 and the inner and outer support walls 82, 84 and is not limited to the configuration described above and shown in the illustrations.

A diverter 90, shown by example in the form of a fin 92, may be located at least partially within the cavity 80. The fin 92 may be an elongated, generally planar body or wall extending radially between the inner and outer support walls 84, 82 approximately equidistant from each of the side walls 56 and depending from the upper wall 58. The fin 92 may have a baffle section with one or more baffles 94, in this case three baffles 94-1, 94-2, 94-3. The baffles 94 may be formed by, for example, angled wall portions of the fin 92 that effect a zig-zag configuration of the fin 92. As shown in the enlarged view of the fin 92 in FIG. 5, some of the baffles 94 may face one direction, while others of the baffles 94 may face another direction. Two of the illustrated exemplary baffles 94-1, 94-3 face one direction, while the other baffle 94-2 faces the opposite direction. The baffles 94-1, 94-2, 94-3 may be arranged so that they zig-zag between the openings 68-1, 68-2, 68-3 such that each of the baffles 94-1, 94-2, 94-3 faces a respective one of the openings 68-1, 68-2, 68-3. Additionally, the diverter 90 may extend below the lower surface of the outer skirt 44, as shown in the sectional view of FIG. 6.

Referring back to FIG. 4, the secondary protrusions 54 may also form an open-bottom cavity 100 on the underside of the base 40. The cavity 100 may be formed between the side walls 70 in the circumferential direction and between the vertex of the secondary protrusions 54 and the outer support wall 82 in the radial direction. The openings 76 may be positioned such that they are between the vertex and outer support wall 82, thereby fluidly communicating the cavity 100 with the area above the impeller 20. The cavity 100 may have any suitable configuration depending on the configuration of the secondary protrusion 54 and the outer support wall 82 and is not limited to the configuration described above and shown in the illustrations.

As with the protrusion 52, a diverter 102, shown by example in the form of a fin 104, may be located at least partially within the cavity 100 of the secondary protrusion 54. The fin 104 may be an elongated, generally planar body or wall extending radially between the vertex and the outer support wall 82 approximately equidistant from each of the side walls 70 and depending from the upper wall 72. The fin 104 may have a baffle section with one or more baffles 106, in this case three baffles 106-1, 106-2, 106-3. The baffles 106 may be formed by, for example, angled wall portions of the fin 104 that effect a zig-zag configuration of the fin 104. Some of the baffles 106 may face one direction, while others of the baffles 106 may face another direction. Two of the illustrated exemplary baffles 106-1, 106-3 face one direction, while the other baffle 106-2 faces the opposite direction. The baffles 106-1, 106-2, 106-3 may be arranged so that they zig-zag between the openings 76-1, 76-2, 76-3 such that each of the baffles 106-1, 106-2, 106-3 faces a respective one of the openings 76-1, 76-2, 76-3. Additionally, the diverter 102 may extend below the lower surface of the outer skirt 44.

Figure 5:
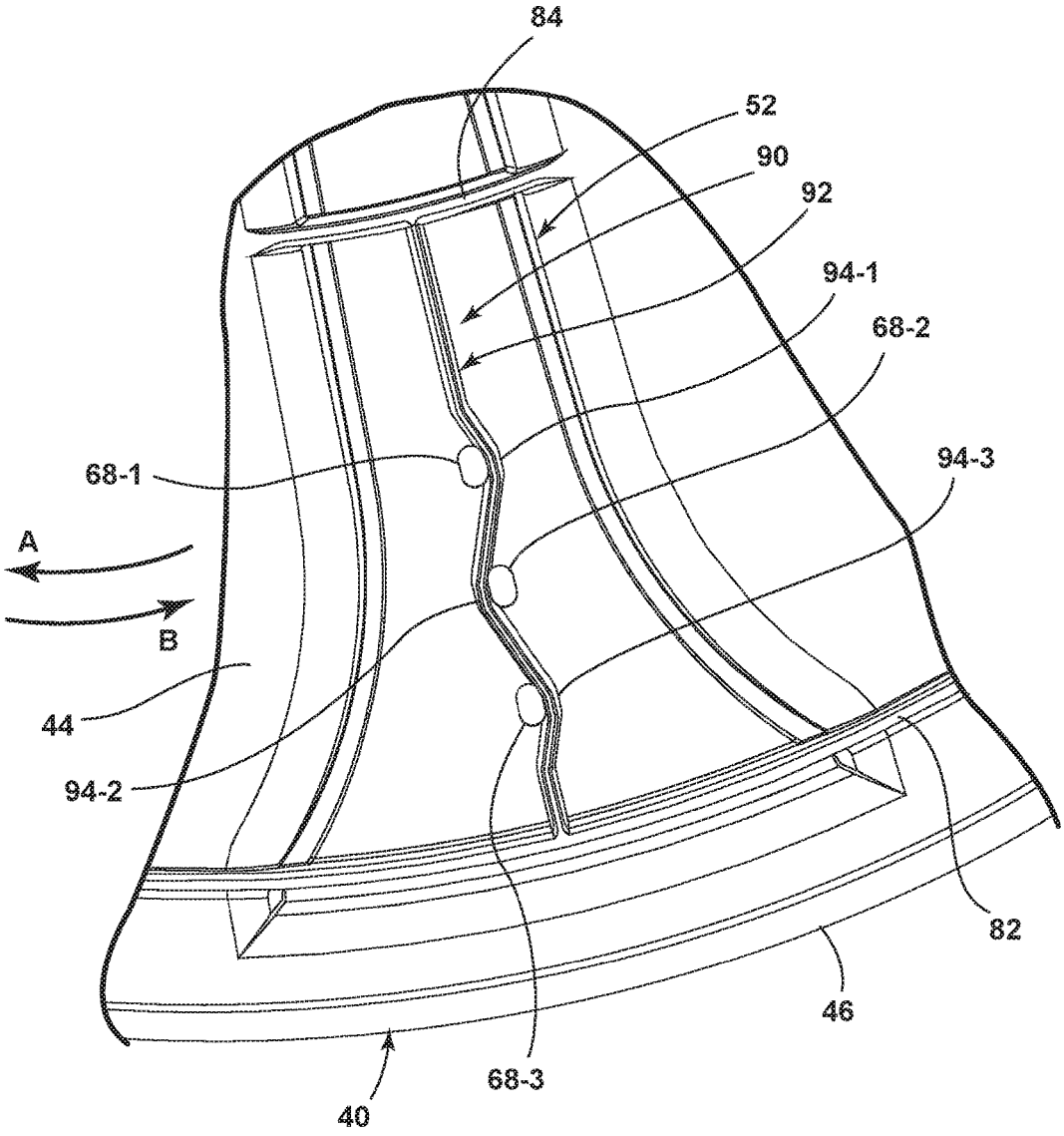
FIG. 5 is an enlarged bottom view of the region identified in FIG. 4.
Figure 6:
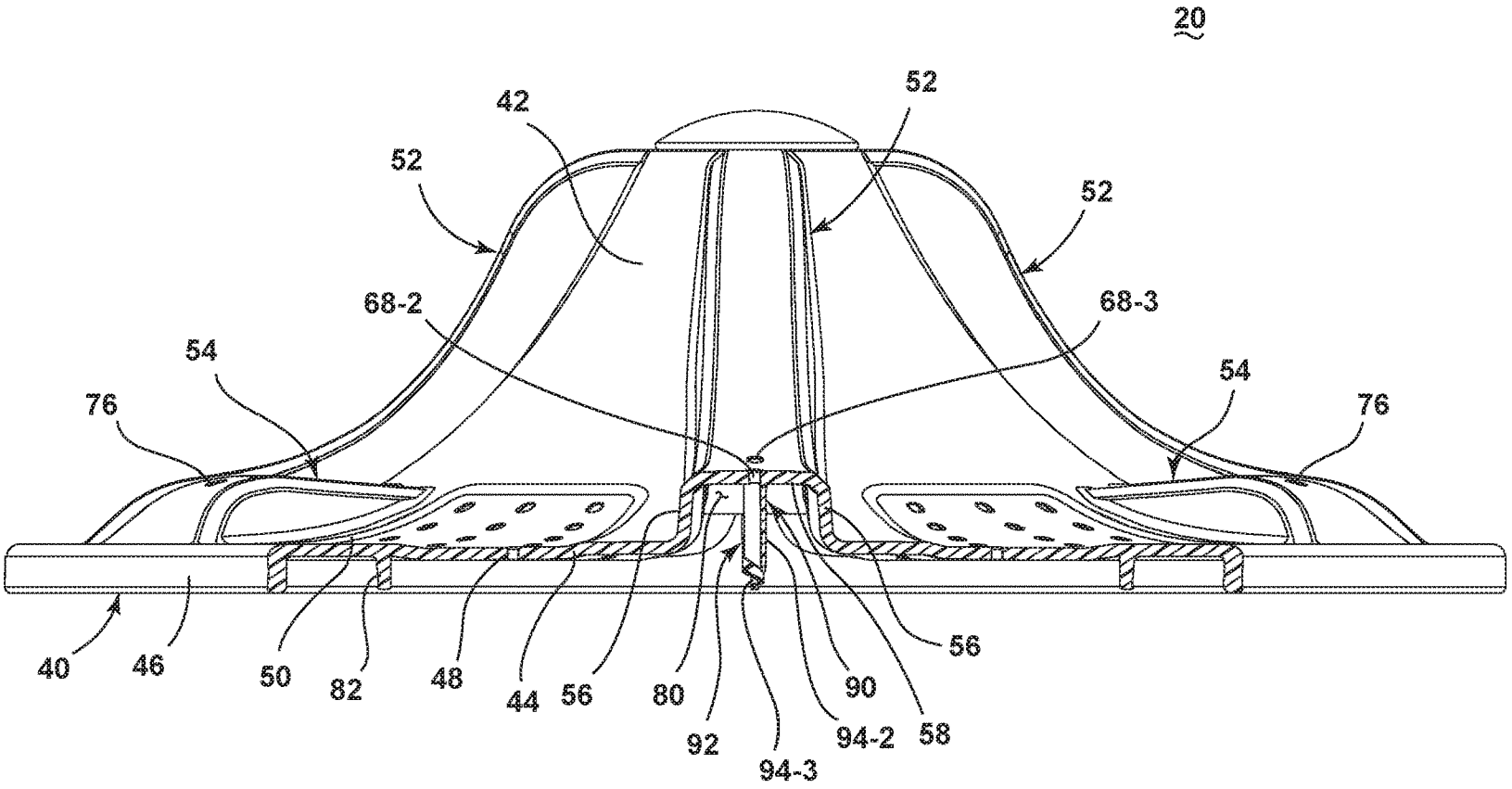
FIG. 6 is a sectional view taken along line VI-VI of FIG. 3.

With continued reference to FIG. 4, during operation of the washing machine 10, the impeller 20 may be rotated about the axis 18 in one direction or opposite directions in an alternating manner. As the impeller 20 moves through the liquid in the basket 16, the diverters 90, 102 that extend below the bottom of the base outer skirt 44 contact the liquid below the impeller 20 and direct the liquid towards the respective cavities 80, 100. Because the baffles 94-1, 94-2, 94-3, 106-1, 106-2, 106-3 face both rotation directions, the diverters 90, 102 direct the liquid into the cavities 80, 100 during rotation of the impeller 20 in both directions. For example, as shown in FIG. 5, during rotation of the impeller in a direction A that is the same direction that the baffles 94-1, 94-3 face, the baffles 94-1, 94-3 contact the liquid and direct the liquid into the cavity 80 toward the respective openings 68-1, 68-3. When the rotation direction switches to a direction B that is the same direction that the baffle 94-2 faces, the baffle 94-2 contacts the liquid and directs the liquid into the cavity 80 toward the opening 68-2. Similar behavior occurs with respect to the baffles 106-1, 106-2, 106-3 and the openings 76-1, 76-2, 76-3 of the secondary protrusions 54 (FIG. 4).

Figure 7:
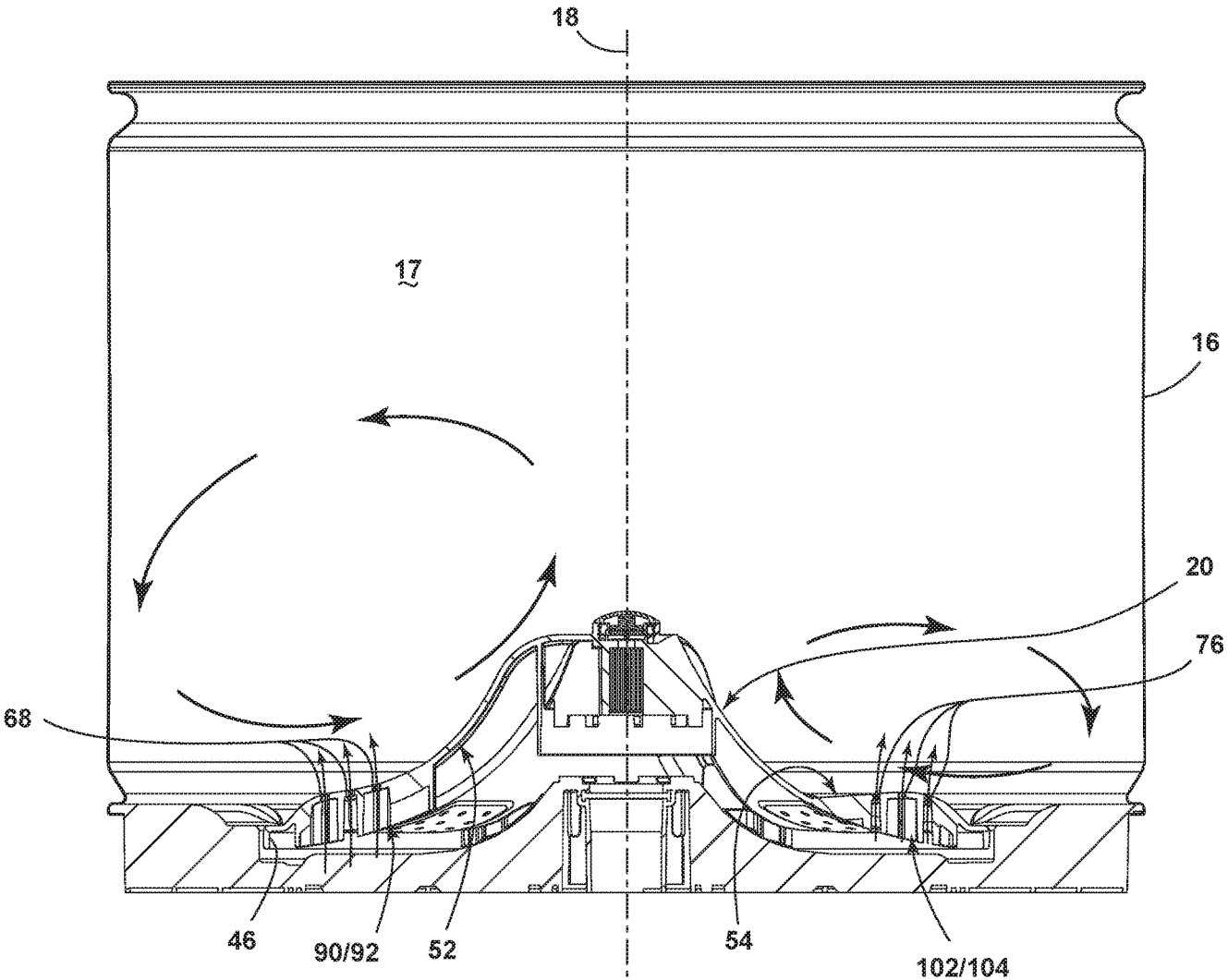
FIG. 7 is a sectional view of a basket and the impeller from the washing machine of FIG. 1.

As explained above, the rotation of the impeller 20 may generate an inverse toroidal rollover of the laundry items above the impeller 20, and the general direction of this movement is shown by arrows in FIG. 7. At the same time, liquid from below the impeller 20 moves through the cavities 80, 100 and is expelled through the respective openings 68, 76 to the portion of the treating chamber 17 above the impeller 20, as also indicated by arrows in FIG. 7. The arrows on the left and right sides of the basket 16 in the figures represent the inverse toroidal rollover for different levels of liquid. The left arrows may be indicative of a relatively deep liquid fill, while the right arrows may correspond to a relatively low liquid fill. Regardless of the level of liquid fill, which may be any suitable level and is not limited to that described above and shown in FIG. 7, because the openings 68, 76 are located towards the outer portion of the impeller 20, the movement of the liquid through the impeller 20 may facilitate movement of laundry items that may gather in dead zones that may form near the bottom corner area of the basket 16. While the pumping of the liquid through the protrusions 52, 54 may be strong enough to free such laundry items, the force of the liquid is not sufficiently strong enough to interfere with the inverse toroidal movement. Thus, the liquid directed through the protrusions 52, 54 may help to keep the laundry items moving in the inverse toroidal direction and reduce or eliminate potential dead zones in the bottom corner area of the basket 16 without detrimentally affecting the desired overall movement of the laundry items.

Figure 8:
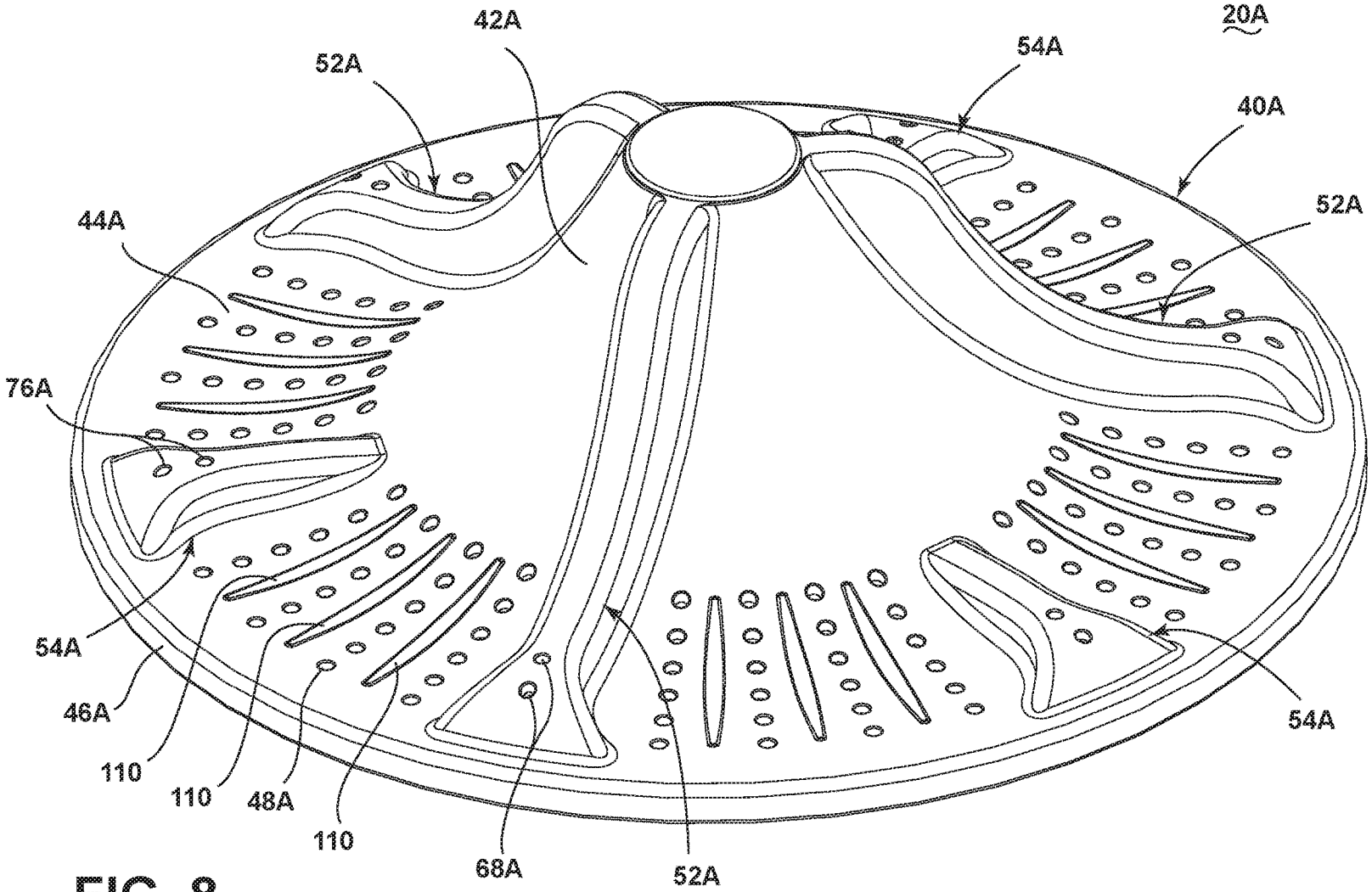
FIG. 8 is a perspective view a laundry mover in the form of an impeller according to another embodiment.

FIG. 8 is a perspective view of an impeller 20A according to another embodiment. Elements similar to those of previous embodiments are identified with the same reference numeral bearing a letter "A." The impeller 20A of FIG. 8 is substantially identical to that of FIGS. 1-7, and the differences are explained below.

The base 40A of the impeller 20A may have the apertures 48A on the outer skirt 44A arranged in generally radial lines separated by radial ridges 110. The apertures 48A may be positioned between the protrusions 52A and the secondary protrusions 54A that have a slightly different configuration than that of the embodiment of FIGS. 1-7. While the shape may differ, the protrusions 52A and the secondary protrusions 54A may include the openings 68A, 76A, and, in this example, each of the protrusions 52A and secondary protrusions 54A may have two of the openings 68A, 76A. The openings 68A, 76A fluidly communicate with the respective open-bottom cavities 80A, 100A, which are seen in the bottom perspective view of FIG. 9.

The fins 92A forming the diverters 90A for the protrusions 52A may be shorter in radial length than the previous embodiment, having two of the baffles 94A facing opposite directions in a zig-zag configuration through the openings 68A, and the inner support wall 84A may accordingly be located further radially outward. The protrusions 52A may further include an additional inner support wall 112 positioned approximately at the transition between the base raised center 42A and outer skirt 44A and functioning to create an air dome beneath the impeller 20A when in the laundry treating chamber 17A.

The fins 104A forming the diverters 102A for the secondary protrusions 54A may also be shorter in radial length than the previous embodiment, having two of the baffles 106A facing opposite directions in a zig-zag configuration through the openings 76A. Further, the secondary protrusions 54A may include an inner support wall 114 spanning the side walls 70 and defining, with the outer support wall 82, the radial dimension of the cavity 100A and supporting the radially inward end of the fin 104A.

Figure 9:
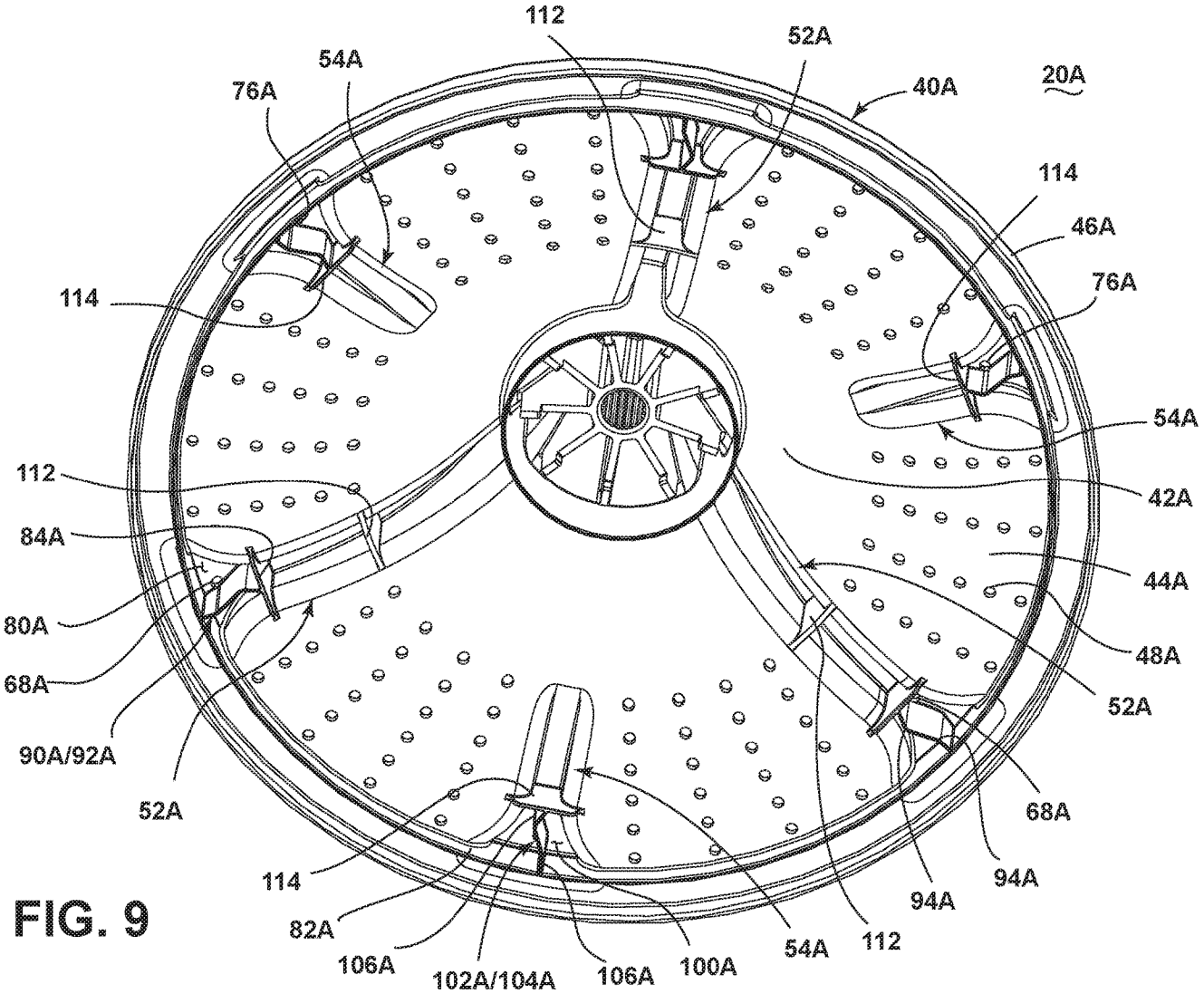
FIG. 9 is a bottom perspective view of the impeller of FIG. 8.

With continued reference to FIG. 9, the operation of the impeller 20A is substantially the same as that of the impeller 20, with the diverters 90A, 102A directing the liquid from below the impeller 20A into the cavities 80A, 100A and through the openings 68A, 76A to the portion of the treating chamber 17A above the impeller 20A. Because the baffles 94A, 106A face both rotation directions, the diverters 90A, 102A direct liquid through the protrusions 52A and secondary protrusions 54A during rotation of the impeller 20A in both directions.

Figure 10:
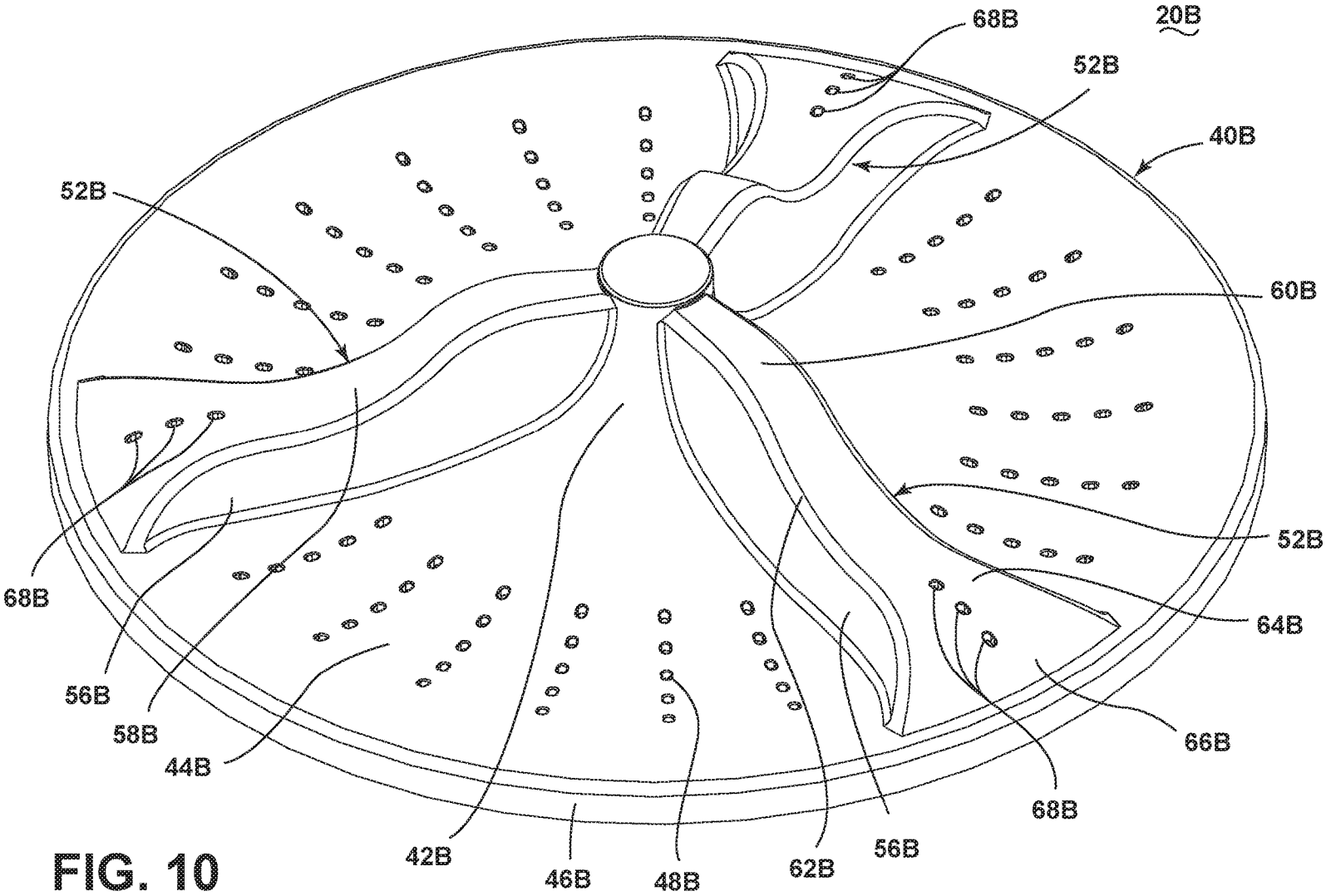
FIG. 10 is a perspective view of a laundry mover in the form of an impeller according to another embodiment.

FIG. 10 is a perspective view of an impeller 20B according to another embodiment. Elements similar to those of previous embodiments are identified with the same reference numeral bearing a letter "B." The impeller 20B of FIG. 10 is similar to that of FIGS. 1-7 in that it includes the base 40B with the plurality of radial protrusions 52B extending upward from the base 40B. The base 40B may include a plurality of the apertures 48B fluidly communicating the areas above and below the impeller 20B. Additionally, each of the protrusions 52B may have the openings 68B through the upper wall 58B and located approximately along the outer section 64B of the protrusion 52B. The openings 68B fluidly communicate the area above the impeller 20B with the open-bottom cavity 80B, shown in the bottom perspective view of FIG. 11.

The fins 92B forming the diverters 90B for the protrusions 52B may extend between the inner and outer support walls 84B, 82B and may have three of the baffles 94B facing opposite directions in a zig-zag configuration through the openings 68B, as in the embodiment of FIGS. 1-7. The protrusions 52B may further include additional inner support walls 112B, 116. While the illustrated impeller 20B lacks secondary projections, such projections, or any other type of projection, with our without a diverter, may be incorporated into the impeller 20B.

Figure 11:
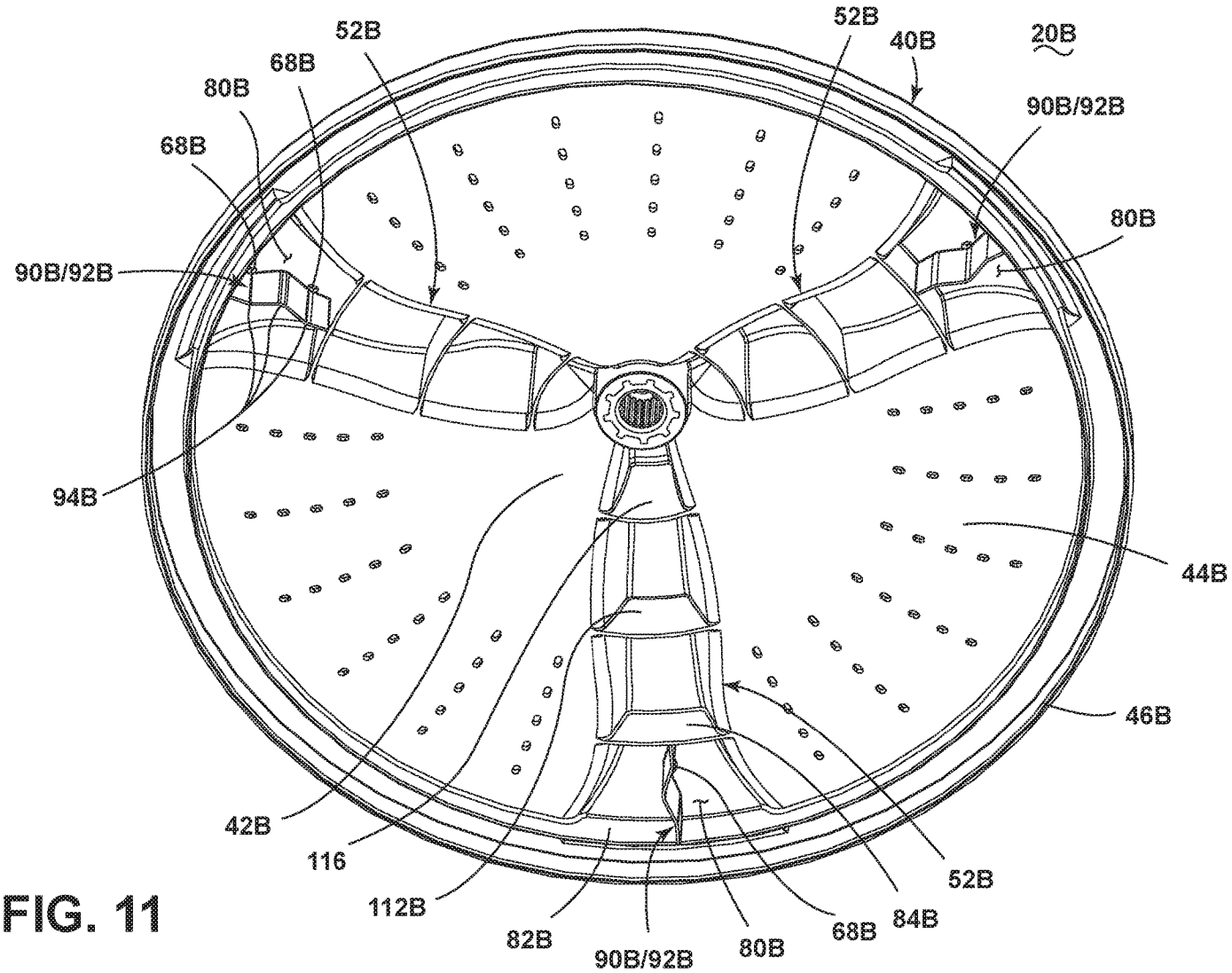
FIG. 11 is a bottom perspective view of the impeller of FIG. 10.

With continued reference to FIG. 11, the operation of the impeller 20B is substantially the same as that of the impeller 20, with the diverters 90B directing the liquid from below the impeller 20B into the cavities 80B and through the openings 68B to the portion of the treating chamber 17B above the impeller 20B. Because the baffles 94B face both rotation directions, the diverters 90B direct liquid through the protrusions 52B during rotation of the impeller 20B in both directions.

Figure 12:
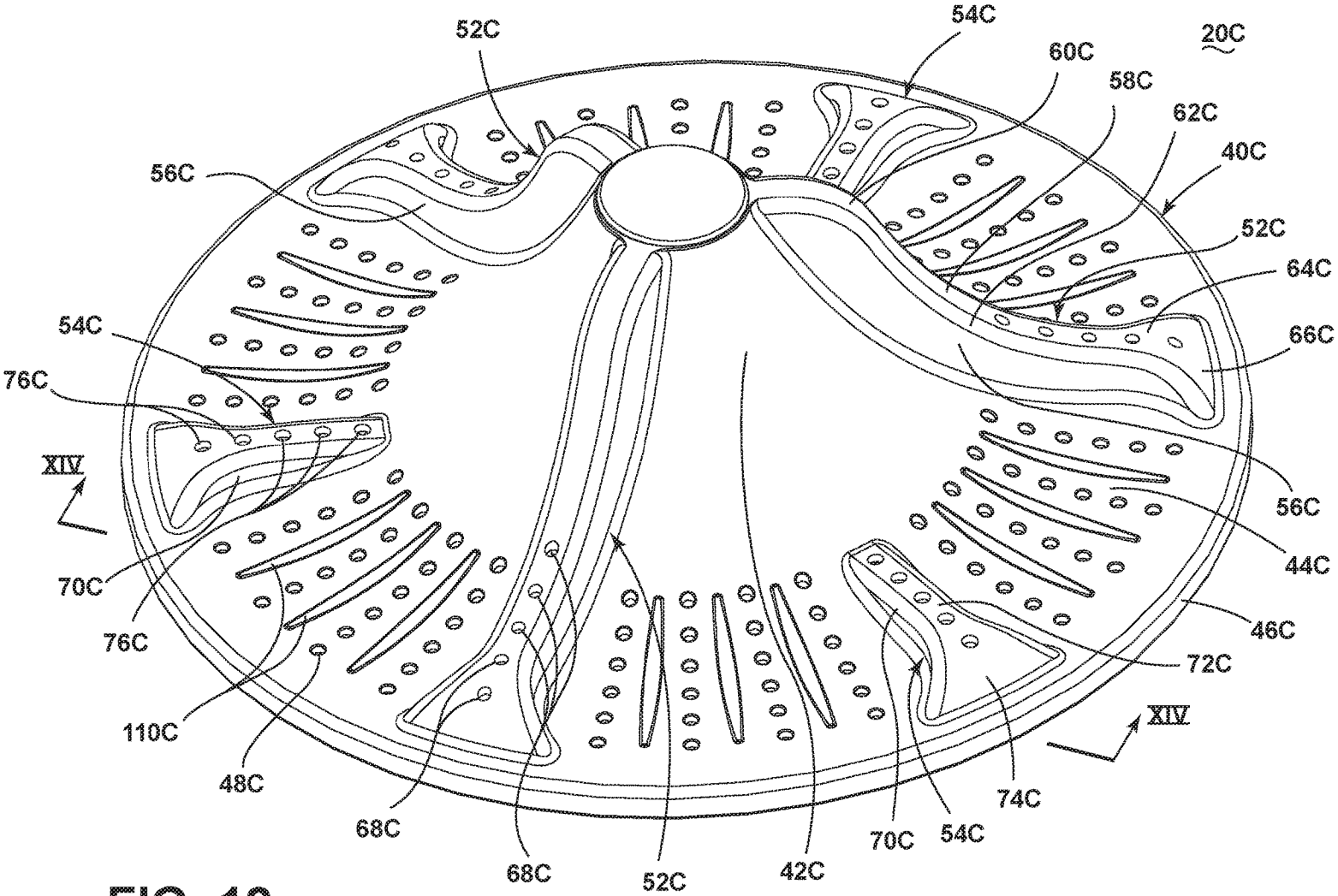
FIG. 12 is a perspective view of a laundry mover in the form of an impeller according to another embodiment.
Figure 13:
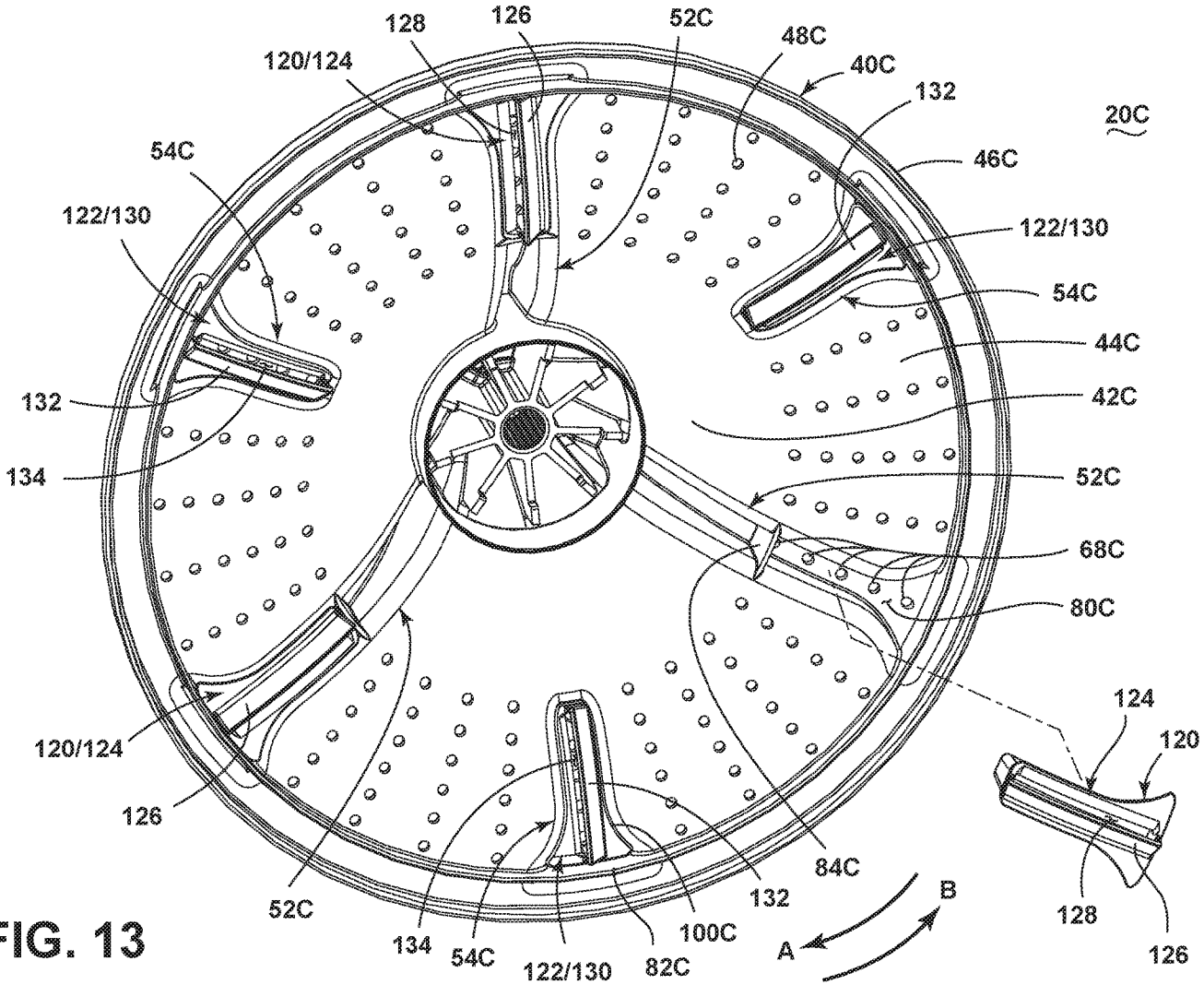
FIG. 13 is a bottom perspective view of the impeller of FIG. 12 with a diverter insert shown in exploded view.

FIG. 12 is a perspective view of an impeller 20C according to another embodiment. Elements similar to those of previous embodiments are identified with the same reference numeral bearing a letter "C." The impeller 20C of FIG. 12 is substantially identical to that of FIGS. 8 and 9, with the exception of a greater number of the openings 68C, 76C in each of the protrusions 52C and the secondary protrusions 54C, specifically five in the illustrated example, and a different type of diverter 120, 122 in the cavities 80C, 100C (FIG. 13). With respect to the openings 68C, 76C, the openings 68C of the protrusions 52C may extend along a portion of the transition 62C and outer section 64C of the protrusions 52C, and the openings 76C of the secondary protrusions 54C may be located along the entire upper wall 72C of the secondary protrusions 54C.

Referring now to FIG. 13, which is a bottom perspective view of the impeller 20C, the cavity 80C formed by each of the protrusions 52C may extend radially between the inner and outer support walls 84C, 82C. The diverter 120 for the cavity 80C may be in the form of an insert 124 shaped for receipt within the cavity 80C and including a depending baffle 126 in the form of an angled wall extending along the radial length of the cavity 80C. As seen in the sectional view of FIG. 14, the baffle 126 extends below the base outer skirt 44C with an acute angle $\alpha$ defined between the baffle 126 and the outer skirt 44C. The insert 124 may also define a through channel 128 that passes through the cavity 80C. The baffle 126 may function as an inlet for the through channel 128, while the openings 68 may serve as an outlet; therefore, the through channel 128 may effectively fluidly connect the baffle 126 with the openings 68C.

Referring back to FIG. 13, the cavity 100C formed by the secondary protrusions 54C may be defined by the area under the secondary protrusions 54C radially inward from the outer support wall 82C. The diverter 122 may also be an insert 130 received by the cavity 100C and having a baffle 132 and a through channel 134. The insert 130 may be substantially identical to the insert 124 for the cavity 80C with the exception of the baffle 132 facing a direction opposite that of the baffle 126 for the insert 124.

The diverters 120, 122 may be arranged on the impeller 20C in an alternating configuration. For example, the impeller 20C may include three of each type of the diverters 120, 122, as shown by example in the illustrated embodiment, with one of the diverters 122 between adjacent diverters 120 and vice-versa. In this configuration, the baffles 126 facing one direction may alternate with the baffles 132 facing the opposite direction. It is contemplated that the impeller 20C may have any suitable number of the diverters 120, 122 arranged in any desired configuration and is not intended to be limited to the configuration shown in the illustrated exemplary embodiment.

With continued reference to FIG. 13, during the operation of the impeller 20C, rotation of the impeller 20C in the direction A, which is the direction that the baffle 132 for the secondary protrusion diverter insert 130 faces, brings the baffles 132 that extend below the bottom of the base outer skirt 44C into contact with the liquid below the impeller 20C, and the baffles 132 direct the liquid into the respective through channel 134 and, thereby, through the cavity 100C. The liquid leaves the cavity 100C through the openings 76C to the region above the impeller 20C. During rotation of the impeller 20C in the direction B, which is the direction that the baffle 126 for the protrusion diverter insert 124 faces, the same process occurs whereby the baffles 126 contact the liquid below the impeller 20C, direct the liquid into the respective through channel 128 and, thereby, the cavity 80C, and expel the liquid through the openings 68C to the region above the impeller 20C. Because the baffles 126, 132 face both rotation directions, the diverters 120, 122 direct liquid through the protrusions 52C and the secondary protrusions 54C during rotation of the impeller 20C in both directions—liquid moves through the protrusions 52C during rotation in one direction and through the secondary protrusions 54C during rotation in the opposite direction.

Figure 15:
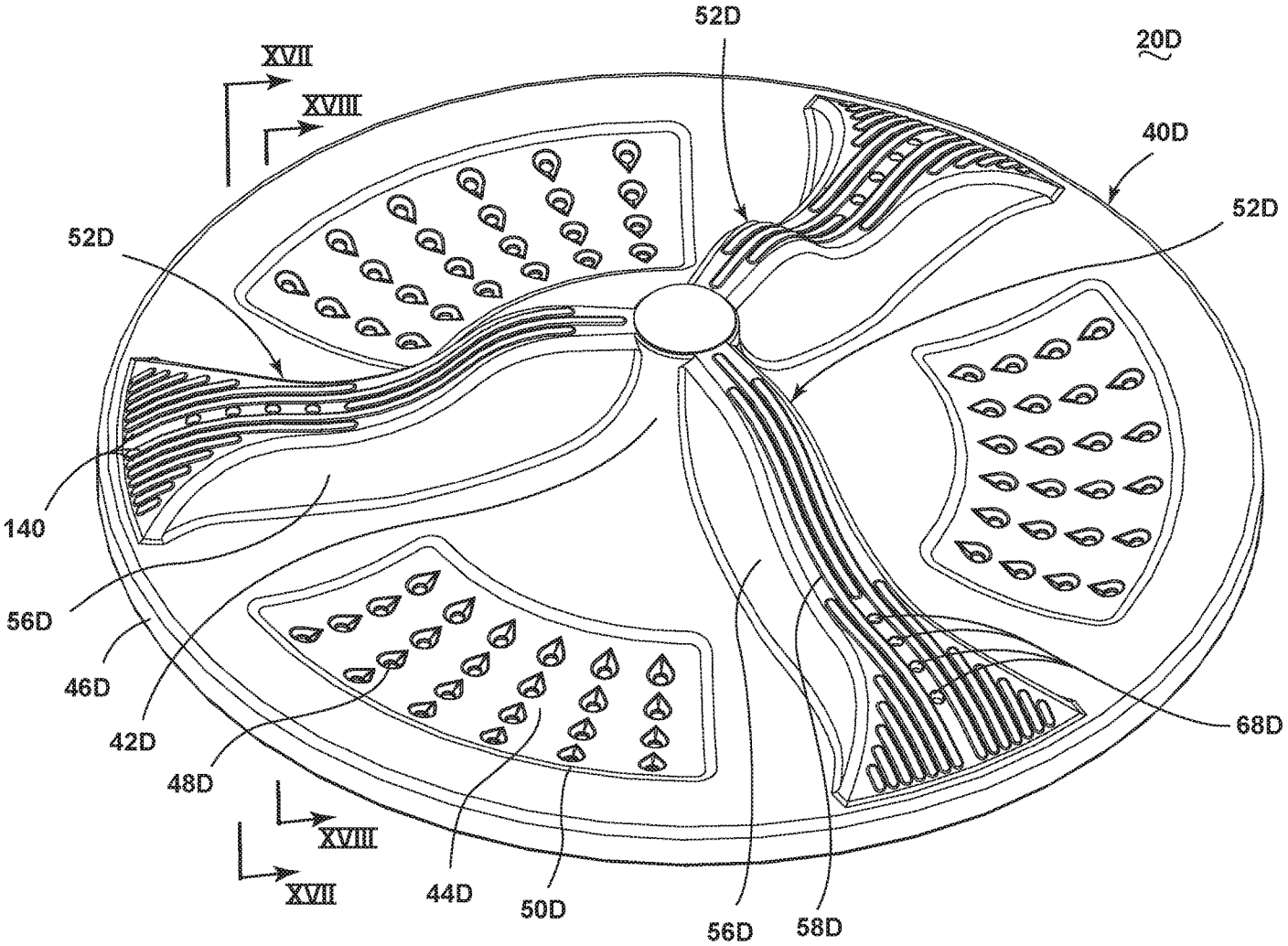
FIG. 15 is a perspective view of a laundry mover in the form of an impeller according to another embodiment.

FIG. 15 is a perspective view of an impeller 20D according to another embodiment. Elements similar to those of previous embodiments are identified with the same reference numeral bearing a letter "D." The impeller 20D of FIG. 15 has the same general configuration as that of FIGS. 10 and 11, with the exception of the apertures 48D being located in depressions 50D on the base 40D, radial ribs 140 along the upper wall 58D of the protrusions 52D, a greater number of the openings 68D in each of the protrusions 52D, specifically four in the illustrated example, and a different type of diverter 142 in the cavities 80D, as seen in FIG. 16.

Figure 16:
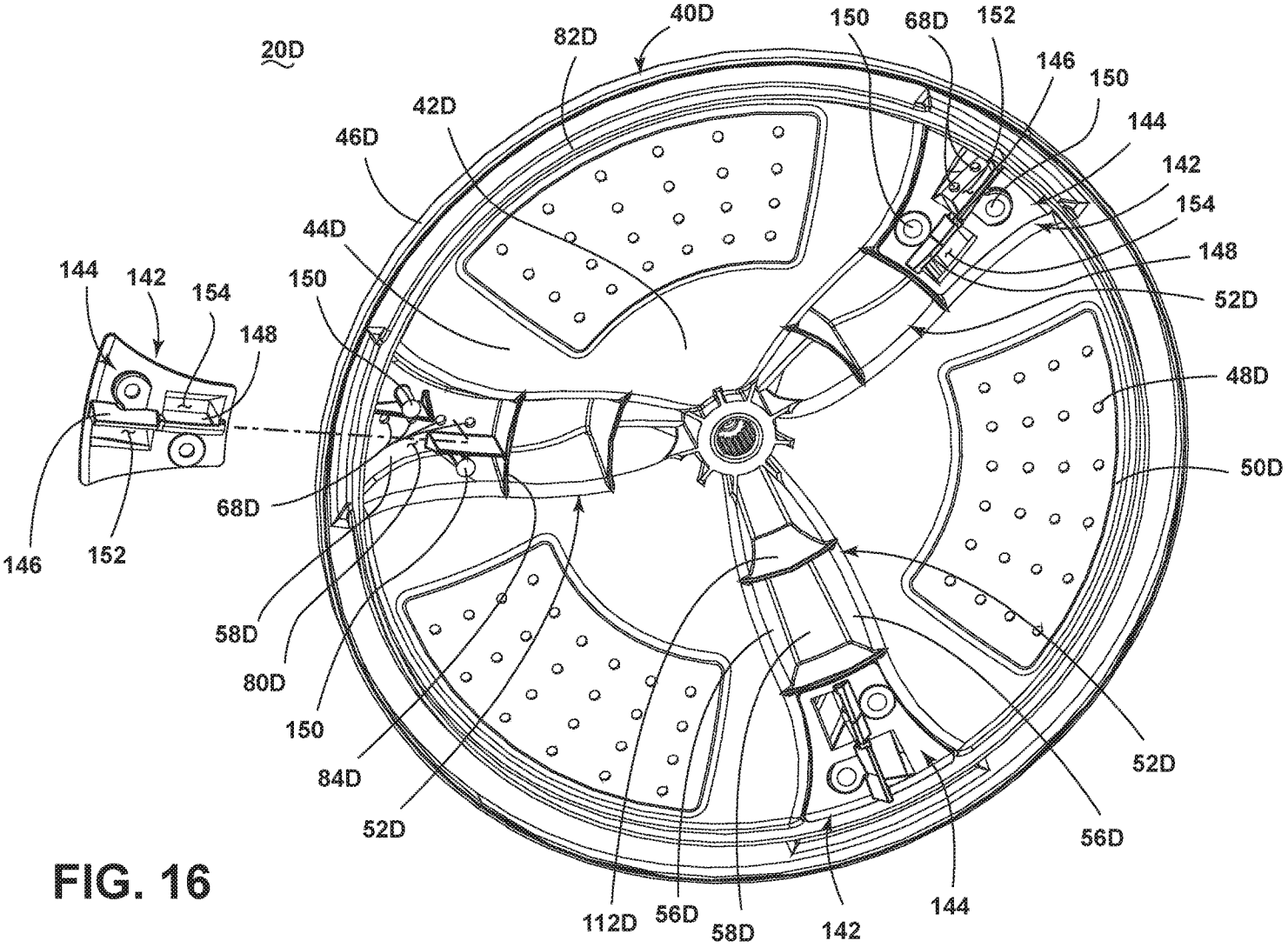
FIG. 16 is a bottom perspective view of the impeller of FIG. 15 with a diverter insert shown in exploded view.
Figure 17:
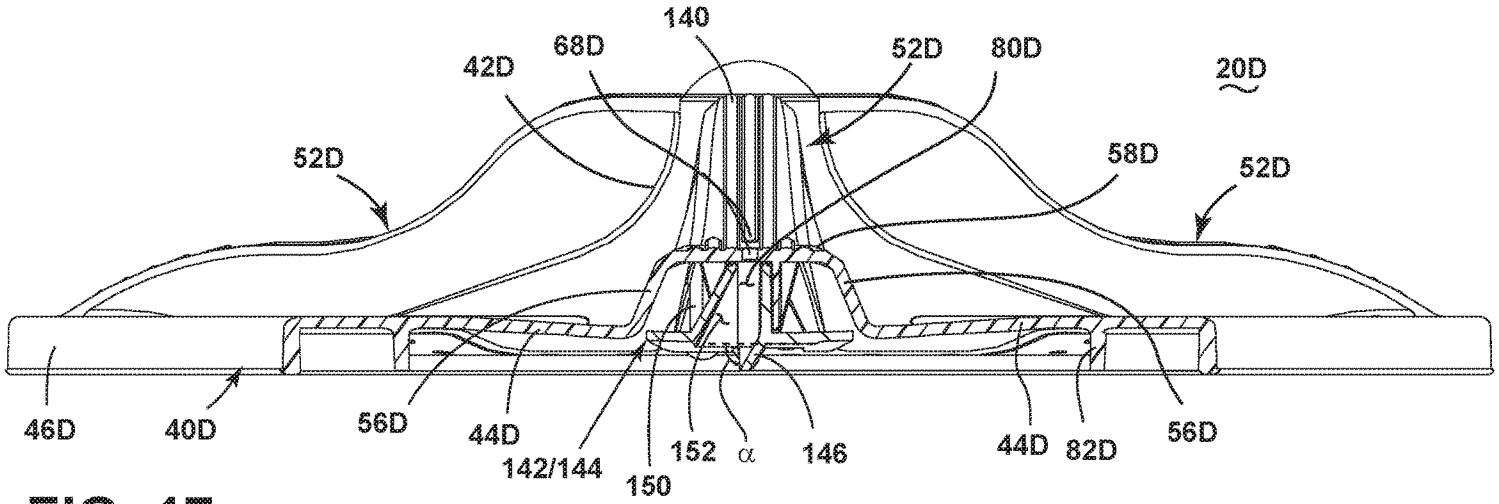
FIG. 17 is a sectional view taken along line XVII-XVII of FIG. 15.
Figure 18:
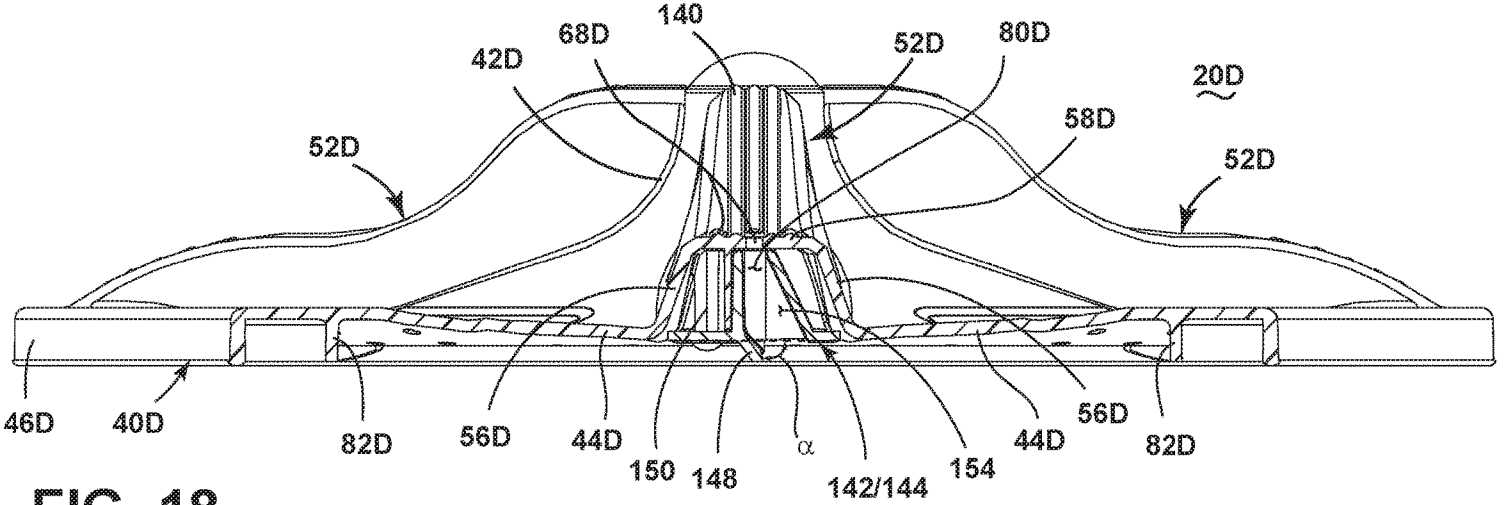
FIG. 18 is a sectional view taken along line XVIII-XVIII of FIG. 15.

With continued reference to FIG. 16, which is a bottom perspective view of the impeller 20D, the cavity 80D formed by each of the protrusions 52D may extend radially between the inner and outer support walls 84D, 82D, and the protrusions 52D may also include the additional inner support wall 112D. The diverter 142 for the cavity 80D may be in the form of an insert 144 shaped for receipt within the cavity 80D and including first and second depending baffles 146, 148 in the form of angled walls facing opposite directions and extending radially along the cavity 80D. Mounting structures 150 may be disposed in the cavity 80D, such as by depending from the protrusion upper wall 58D, to facilitate mounting the insert 144 in the cavity 80D. The mounting structures 150 may include posts for heat staking the insert 144 within the cavity 80D. Other examples of means for mounting the insert 144 in the cavity 80D include, but are not limited to, adhesives, mechanical fasteners, and an interference fit. As seen in the sectional views of FIGS. 16 and 17, which are taken at different radial distances along the protrusion 52D, the baffles 146, 148 extend below the base outer skirt 44D with an acute angle $\alpha$ defined between each of the baffles 146, 148 and the outer skirt 44D. The insert 144 may also define through channels 152, 154 for the respective baffles 146, 148 that pass through the cavity 80D, as in the previous embodiment of FIGS. 12-14. Each of the through channels 152, 154 may fluidly communicate with some of the openings 68D, such as two of the four openings 68D in each of the illustrated exemplary protrusions 52D.

Figure 14:
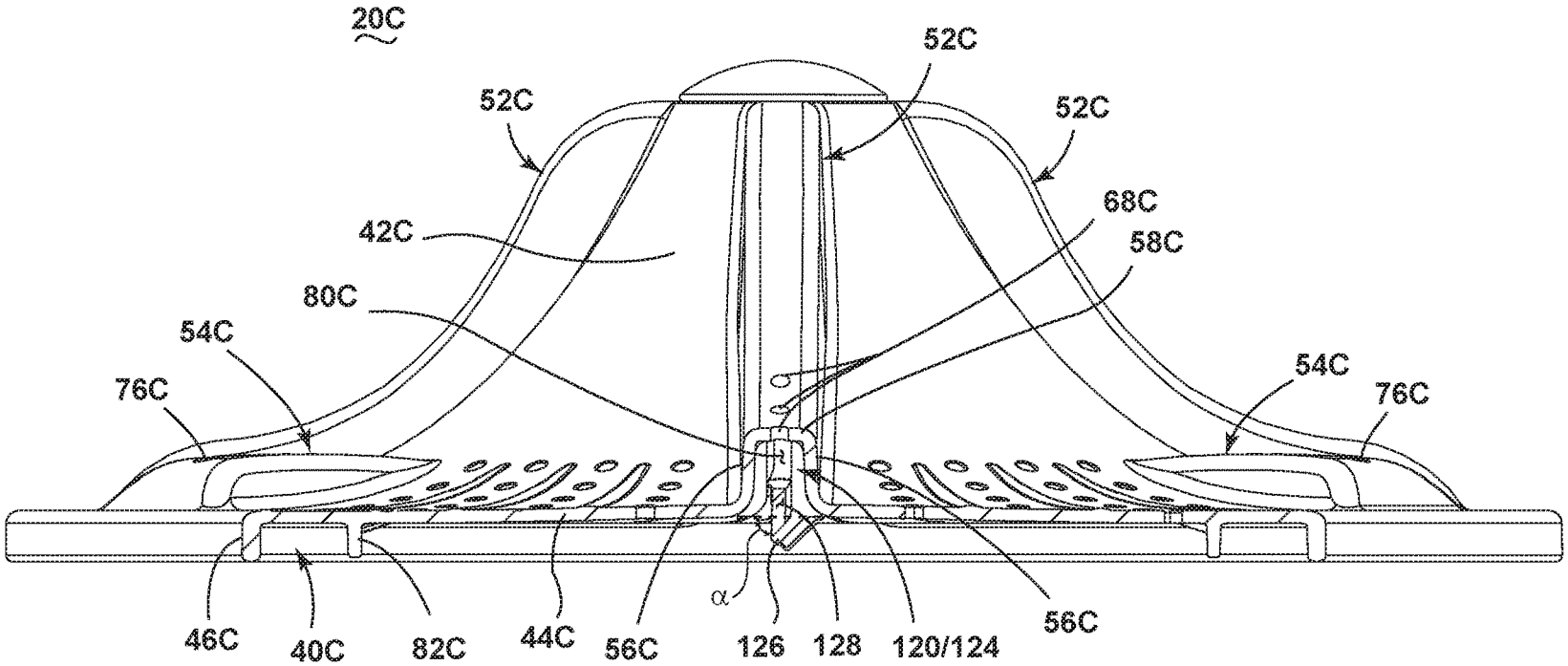
FIG. 14 is a sectional view taken along line XIV-XIV of FIG. 12.

The operation of the impeller 20D is substantially the same as that of the impeller 20D of FIGS. 12-14, except that because each of the individual diverters 142 has the two baffles 146, 148 facing opposite directions, each individual diverter 142 directs liquid from below the impeller 20D and through the cavity 80D to above the impeller 20D during rotation of the impeller 20D in both directions rather than in only one direction.

Various modifications may be made to the laundry mover. For example, the diverter in the form of the fin may have arcuate walls or another configuration for the baffles rather than angled walls. Further, each fin need not include multiple baffles; the fin may include only a single baffle if desired, and the fins may be arranged on the impeller so that the direction of the baffles alternate circumferentially, as with the baffles of the embodiment of FIGS. 12-14. As an example of another modification, the walls forming the baffles for the diverter in the form of the insert may be angled and planar, as illustrated, arcuate so as to form a scoop, or another desired configuration. Additionally, regardless of the type of the diverter, the impeller may employ diverters with unidirectional baffles all facing the same direction so that the diverters direct the water through the cavities and openings of the protrusions and, if present, secondary protrusions only during rotation in one direction. Even further, other types of diverters beyond the fin and insert diverters described above and shown in the illustrations as examples may be employed with a laundry mover to direct liquid through the protrusions and, if present, secondary protrusions.

The particular configuration of the base and the protrusions may be modified as well. The diverters may be employed with any shape and number of protrusions and/or secondary protrusions and are not limited to use with those described above and shown in the figures. The exemplary embodiments show three protrusions and, if present, three secondary protrusions; more or less protrusions may be employed, including no secondary protrusions, and other types of protrusions may be combined with the base and diverter as well. Further, the protrusions may be disposed on any type of base with any arrangement of apertures, including no apertures.

To the extent not already described, the different features and structures of the various embodiments may be used in combination with each other as desired. That one feature may not be illustrated in all of the embodiments is not meant to be construed that it may not be, but is done for brevity of description. Thus, the various features of the different embodiments may be mixed and matched as desired to form new embodiments, whether or not the new embodiments are expressly described. All combinations or permutations of features described herein are covered by this disclosure. The primary differences among the exemplary embodiments relate to the type of diverter (e.g., fin with bidirectional baffles, insert with unidirectional baffles, insert with bidirectional baffles), configuration of the protrusions, presence and configuration of secondary protrusions, and the configuration of the base, and these features may be combined in any suitable manner to modify the above described embodiments and create other embodiments. As examples, the inserts having the unidirectional baffle of FIGS. 12-14 can be incorporated into the impeller of FIGS. 15-18 rather than using the inserts with the bidirectional baffles, the impellers of FIGS. 10-11 and 15-18 may include secondary protrusions from the other illustrated embodiments, and any of the embodiments may employ a combination of the fin diverter and insert diverters.

While the invention has been specifically described in connection with certain specific embodiments thereof, it is to be understood that this is by way of illustration and not of limitation, and the scope of the appended claims should be construed as broadly as the prior art will permit.

What is claimed is:

1. A laundry treating appliance comprising:

a treating chamber receiving laundry for treatment; and a laundry mover located in the treating chamber and rotatable about a rotational axis, the laundry mover comprising:

a protrusion located on an upper side of the laundry mover and forming an open cavity on a lower side of the laundry mover, the protrusion further having at least one opening fluidly communicating the cavity with a portion of the treating chamber above the protrusion; and a diverter located entirely within the open cavity on a lower side of the laundry mover and depending from an upper wall of the protrusion within the open cavity.

2. The laundry treating appliance of claim 1 wherein the diverter is in the form of a fin.

3. The laundry treating appliance of claim 2 wherein the fin extends radially along at least a portion of the cavity.

4. The laundry treating appliance of claim 3 wherein the fin comprises at least one baffle facing the at least one opening directing liquid toward the at least one opening.

5. The laundry treating appliance of claim 4 wherein the at least one opening further comprises a first opening and a second opening, and the at least one baffle further comprises at least two baffles facing opposite directions with a first baffle facing the first opening, and with a second baffle facing the second opening.

6. The laundry treating appliance of claim 4 wherein the at least one baffle is formed by angled walls in a zig-zag configuration.

7. The laundry treating appliance of claim 3 wherein the protrusion further comprises opposing sidewalls joined at one end by an outer wall, and an inner support wall spans the cavity between the sidewalls, wherein the fin extends from the outer wall to the inner support wall.

8. The laundry treating appliance of claim 7 wherein the protrusion further comprises an additional wall located radially inward from the inner support wall forming an air dome beneath a portion of the laundry mover.

9. The laundry treating appliance of claim 3 wherein the protrusion further comprises opposing sidewalls that converge at a vertex at one end and are joined by an outer wall at another end, wherein the fin extends from the outer wall to the vertex.

10. The laundry treating appliance of claim 1 wherein the laundry mover further comprises a skirt from which the protrusions extend upwardly, and the diverter projects downward below the skirt.

11. The laundry treating appliance of claim 1 wherein the diverter is in the form of a baffle extending radially along at least a portion of the protrusion.

12. The laundry treating appliance of claim 11 wherein the laundry mover further comprises a skirt, and the protrusion extends upwardly from the skirt, wherein the baffle is formed by an angled wall facing the at least one opening with an acute angle between the angled wall and the skirt.

13. The laundry treating appliance of claim 12 wherein the baffle is formed in an insert mounted within the cavity of the protrusion.

14. The laundry treating appliance of claim 13 wherein the insert is mounted within the cavity by at least one of adhesive, heat staking, or mechanical fasteners.

15. The laundry treating appliance of claim 11 wherein the laundry mover comprises multiple protrusions, each having a baffle, and at least a first baffle for a first protrusion faces a first direction, and at least a second baffle for a second protrusion faces a second direction opposite the first direction.

16. The laundry treating appliance of claim 11 wherein the protrusion further comprises a through channel extending through the cavity and fluidly connecting the baffle with the at least one opening.

17. The laundry treating appliance of claim 16 wherein the baffle and the through channel are formed in an insert mounted within the cavity of the protrusion.

18. The laundry treating appliance of claim 11 wherein the at least one opening further comprises a first opening and a second opening, and the diverter further comprises at least two baffles facing opposite directions with a first baffle facing the first opening, and with a second baffle facing the second opening.

19. The laundry treating appliance of claim 1 wherein the laundry mover is an impeller comprising an outer skirt that transitions to a raised center, and the protrusion is radially oriented with the at least one opening located on a portion of the protrusion extending upwardly from the outer skirt.

20. The laundry treating appliance of claim 19 wherein the outer skirt has a plurality of apertures fluidly communicating portions of the treating chamber above and below the outer skirt.

* * * * *